US010022892B2

(12) United States Patent
Kankkunen

(10) Patent No.: US 10,022,892 B2
(45) Date of Patent: Jul. 17, 2018

(54) METHOD AND FACILITY FOR CUTTING CONCRETE PRODUCT

(71) Applicant: Elematic Oyj, Akaa (FI)

(72) Inventor: Heikki Kankkunen, Vantaa (FI)

(73) Assignee: Elematic Oyj, Akaa (FI)

( * ) Notice: Subject to any disclaimer, the term of this patent is extended or adjusted under 35 U.S.C. 154(b) by 114 days.

(21) Appl. No.: 14/692,853

(22) Filed: Apr. 22, 2015

(65) Prior Publication Data

US 2015/0298350 A1 Oct. 22, 2015

(30) Foreign Application Priority Data

Apr. 22, 2014 (FI) ..... 20145371

(51) Int. Cl.

| | |
|---|---|
| ***B24B 1/00*** | (2006.01) |
| ***B28B 17/00*** | (2006.01) |
| ***B28B 11/12*** | (2006.01) |
| ***B24C 1/04*** | (2006.01) |
| ***B28B 11/08*** | (2006.01) |
| ***B28B 11/16*** | (2006.01) |
| ***B26F 3/00*** | (2006.01) |
| ***B26D 3/08*** | (2006.01) |
| *B28B 1/08* | (2006.01) |

(52) U.S. Cl.

CPC ..... *B28B 17/0036* (2013.01); *B24C 1/045* (2013.01); *B26D 3/08* (2013.01); *B26F 3/004* (2013.01); *B28B 11/0863* (2013.01); *B28B 11/12* (2013.01); *B28B 11/16* (2013.01); *B28B 1/084* (2013.01)

(58) Field of Classification Search

USPC ..... 451/36, 38, 40; 264/156, 157

See application file for complete search history.

(56) References Cited

U.S. PATENT DOCUMENTS

| | | | | |
|---|---|---|---|---|
| 4,613,472 | A * | 9/1986 | Svanholm | B28B 1/50 249/80 |
| 5,035,100 | A * | 7/1991 | Sachs | B28B 11/0863 264/138 |
| 5,529,735 | A * | 6/1996 | Durham | B28B 11/006 264/154 |

(Continued)

FOREIGN PATENT DOCUMENTS

| | | |
|---|---|---|
| EP | 1134061 | 9/2001 |
| FI | 101692 | 12/1996 |

(Continued)

OTHER PUBLICATIONS

European Search Report on Application No. 15164046.3-1703 dated Sep. 15, 2015.

(Continued)

*Primary Examiner* — Joseph J Hail
*Assistant Examiner* — Shantese McDonald
(74) *Attorney, Agent, or Firm* — Berggren LLP

(57) ABSTRACT

Method and facility or apparatus for cutting a slipform cast hollow-core concrete product with water jet cutting, wherein in the outer surface of the fresh cast hollow-core concrete product is formed depressions or grooves in the areas to be cut with water jet cutting before curing of the hollow-core concrete product, which depressions or grooves extend in the area of the hollow-cores of the concrete product.

6 Claims, 3 Drawing Sheets

(56) References Cited

U.S. PATENT DOCUMENTS

| | | | | |
|---|---|---|---|---|
| 5,927,129 | A * | 7/1999 | Thoms | B26D 3/164 219/121.67 |
| 6,845,591 | B1 * | 1/2005 | van Paassen | E04B 5/48 52/220.1 |
| 2008/0110311 | A1 | 5/2008 | Stangherlin | |

FOREIGN PATENT DOCUMENTS

| | | |
|---|---|---|
| FR | 2211874 | 7/1974 |
| GB | 2281050 | 2/1995 |
| JP | H0516120 | 1/1993 |

OTHER PUBLICATIONS

Office Action issued on corresponding Finnish Pat. App. No. 20145371 dated Oct. 15, 2014.

Andreas Momber, "Schneidversuche an Stahlbeton mit dem Abrasiv-Druckwasserstrahlen," 186 Beton und Stahlbetonbau 89 (May 1994), No. 5, Berlin, DE, pp. 132-134.

* cited by examiner

METHOD AND FACILITY FOR CUTTING CONCRETE PRODUCT

This application claims benefit of Finnish Patent Application No. 20145371, filed 22 Apr. 2014, the entire content of which is incorporated by reference herein for all purposes.

BACKGROUND

1. Field

The present disclosure relates to cutting of prefabricated concrete products. More precisely the present disclosure relates to a method and an apparatus for cutting cured slipform cast hollow-core concrete products with water jet cutting.

2. Description of Related Art

Prefabricated concrete elements, such as hollow-core slabs and solid concrete slabs, are conventionally cast by slipform casting on long casting beds as a continuous casting process. The length of said continuous casting process is defined either on the basis of the total length of the elements to be cast, or on the basis of the maximum length of the casting bed. The length of casting beds used in slipform casting can be up to 150-200 m, depending on the size of the element plant. When a slipform casting equipment has cast a continuous slab on a casting bed, the cast concrete mass is allowed to be cured on the casting bed. After the concrete mass has cured, the uniform cast element is cut, generally by sawing, into pieces with predetermined lengths on the basis of the design characteristics of the ready-made elements, and the cut concrete elements are lifted off the casting bed to storage, to wait for transportation to their appointed targets of usage.

Generally, concrete elements cast by slipform casting are prestressed, i.e., they are provided with reinforcing wires. Moreover, after slipform casting, the cast concrete elements can be provided with different apertures or cavities, for example for lead-ins or other required post-casting build-up of the elements. Apart from regular concrete mass, the casting material of slipform cast concrete elements can be, for example, fiber reinforced concrete mass.

For sawing cured concrete elements, there is usually employed a saw, or sawing equipment, with a diamond blade, because in hardness, cured concrete mass corresponds to rock material, and often it is also provided with reinforcing steel wires.

The sawing of a fresh, green element is also possible, but in that case the element to be sawed cannot contain reinforcing wires, or the sawing needs to be restricted in the areas not containing the reinforcing wires, because in a fresh element, the reinforcing wires would be detached from the cast element owing to their degree of prestressing, and this would lead to destructive results for the element.

Water jet cutting with abrasive water jet has also been experimented for cutting cured slipform cast products, but this is problematic for hollow-core slabs, since the hollow-core areas tends to break up the water jet and thus greatly decelerate the cutting process.

SUMMARY

The invention, in an embodiment, provides a method for cutting a cured slipform cast hollow-core concrete product with water jet cutting, wherein in the outer surface of the fresh cast hollow-core concrete product is formed depressions and/or grooves before curing of the hollow-core concrete product in the areas to be cut with water jet cutting, which depressions or grooves extend in the area of the hollow-cores of the concrete product.

Since the formed depressions or grooves extend to the area of the hollow-cores of the concrete product, the water jet only needs to cut the lower portion of the cured hollow-core concrete product without any open areas, which significantly speeds up the cutting process. Further, the formation of the depressions or grooves is easily and quickly implemented to the fresh uncured hollow-core concrete product, when compared to a cured concrete product.

The depression or groove is preferably 10-70 mm deep, but may also extend close to the reinforcing wires of the slipform cast concrete product. The width of the depression or groove is preferably 5-100 mm, but may also be greater. Suitable water pressure for the water jet cutting of the cured hollow-core concrete product is about 3000 bar and water feed about 18 l/min. Suitable amount of abrasive to be included in the water jet is about 0.5-1 kg/min.

In an embodiment of the invention the grooves can be provided for transverse cutting as well as longitudinal cutting of the hollow-core concrete product with a water jet cutting, and the depressions and/or grooves can be provided also for any and all other water jet cuttings. With an embodiment of the invention it is also possible to only create depressions to the hollow-core concrete.

In the method of an embodiment of the invention, the formed depressions or grooves in the concrete hollow-core product are preferably large enough to contain the nozzle of the water jet cutting device. This allows taking the nozzle close to the surface to be cut, which makes the water jet cutting process more efficient.

In the method of an embodiment of the invention, the forming of depressions or groves is preferably implemented at the casting place, i.e., on a slipform casting bed, and after the curing the hollow-core concrete product is preferably transferred from the casting place to a separate workstation for the water jet cutting. This embodiment allows the cured and at length cut hollow-core concrete products to be removed from the casting bed before carrying out the required water jet cutting procedures. Further, this embodiment allows the water jet cutting apparatus to be part of a stationary workstation.

When the water jet cutting is implemented at a separate workstation, the cured hollow-core concrete product may be turned over, which allows the water jet cutting from the opposite side of the hollow-core concrete product from the forming of the depressions or grooves. This level surface enhances further the water jet cutting procedure.

The present invention, in an embodiment, also provides an apparatus for cutting a slipform cast hollow-core concrete product with water jet cutting, which apparatus comprises means and devices for slipform casting a hollow-core concrete product, and a water jet cutting device, wherein the facility further comprises a device for forming depressions and grooves in outer surface of the fresh cast hollow-core concrete product before curing of the hollow-core concrete product, said depressions and grooves extending in the area of the hollow-cores of the product.

In the apparatus of an embodiment of the invention, the device for forming depressions and grooves preferably comprises a rotary elongate milling tool for milling the surface of the fresh cast hollow-core concrete product. This milling-type working of the fresh slipform cast concrete product works well with highly compacted and very dense fresh concrete mass obtained with extruder-type slipform casting process before curing of the concrete mass.

The apparatus of an embodiment of the invention preferably comprises a separate workstation for water jet cutting of the cured hollow-core concrete product, and suitable devices, such as bridge cranes, for transferring the cured hollow-core concrete product to the separate workstation for water jet cutting.

The features of a method according to an embodiment of the invention are, more precisely, a method for cutting a slipform cast hollow-core concrete product with water jet cutting, characterized in that in the outer surface of the fresh cast hollow-core concrete product is formed depressions or grooves before curing of the hollow-core concrete product in the areas to be cut with water jet cutting, which depressions or grooves extend in the area of the hollow-cores of the concrete product. The features of an apparatus according to an embodiment of the invention are, more precisely, a facility or apparatus for cutting a slipform cast hollow-core concrete product with water jet cutting, which facility comprises means and devices for slipform casting a hollow-core concrete product, and a water jet cutting device, characterized in that the facility comprises a device for forming depressions and grooves in outer surface of the fresh cast hollow-core concrete product before curing of the hollow-core concrete product, said depressions and grooves extending in the area of the hollow-cores of the product. Other features of various embodiments of the invention include embodiments:

wherein the formed depressions or grooves in the concrete hollow-core product are large enough to contain the nozzle of the water jet cutting device;

wherein the forming of depressions or grooves is implemented at casting place, and after the curing the hollow-core concrete product is transferred from the casting place to a separate workstation for the water jet cutting;

wherein the water jet cutting is implemented from the opposite side of the hollow-core concrete product than the forming of the depressions or grooves;

wherein the device for forming depressions and grooves comprises a movable rotary elongate milling tool for milling the surface of the fresh cast hollow-core concrete product;

wherein the facility or apparatus further comprises a separate workstation for water jet cutting of the cured hollow-core concrete product;

wherein the facility or apparatus further comprises devices for transferring the cured hollow-core concrete product to the separate workstation for water jet cutting.

BRIEF DESCRIPTION OF DRAWINGS

Exemplifying embodiments of the invention and its various advantages are explained in greater detail below in the sense of example and with reference to accompanying drawings, where.

DETAILED DESCRIPTION OF SPECIFIC EMBODIMENTS

Figure 1:
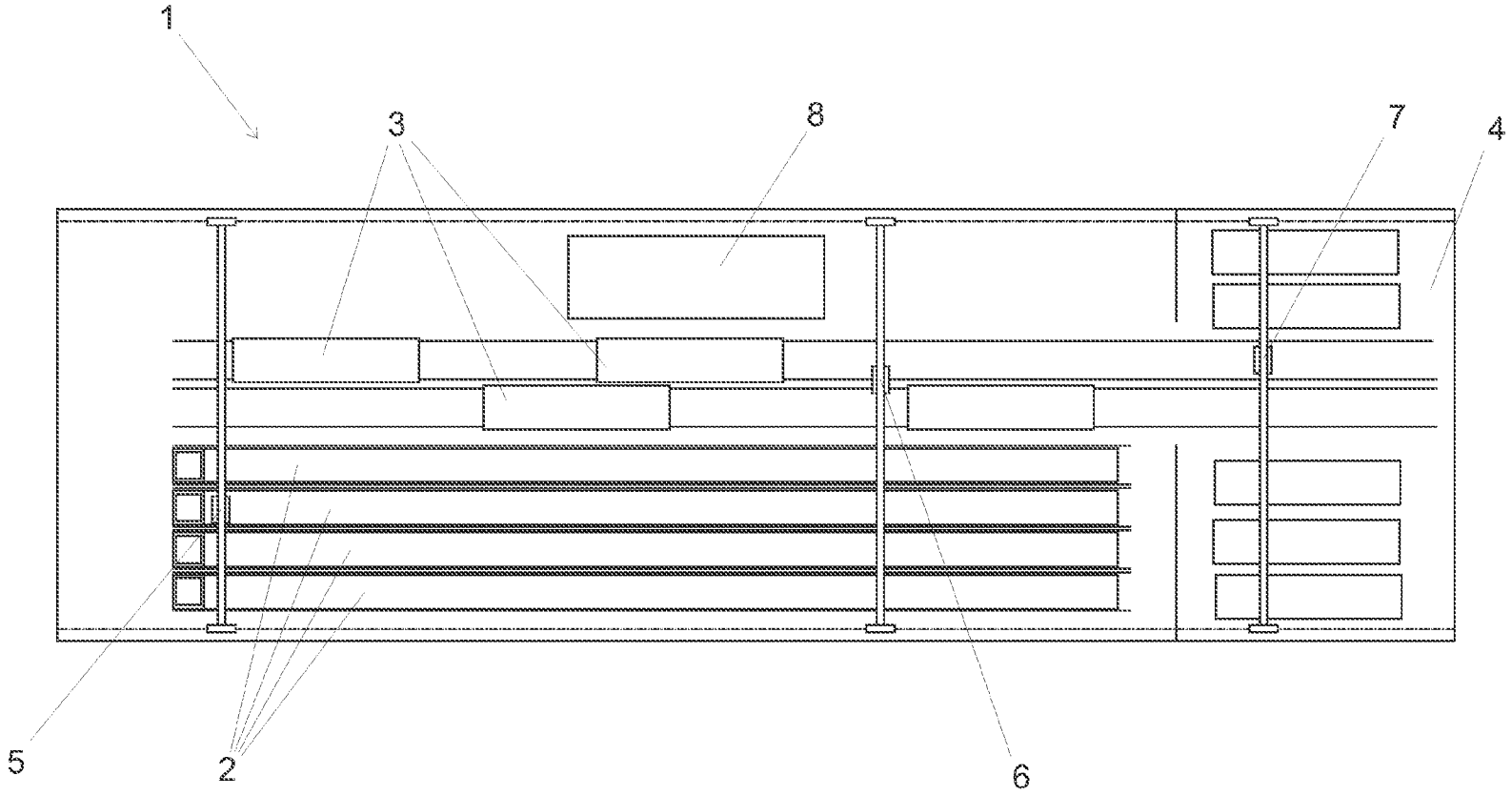
FIG. 1 shows schematically a layout of a manufacturing facility according to an embodiment of the invention.

The manufacturing facility 1 for casting and cutting slipform cast hollow-core concrete products shown in FIG. 1 comprises a plurality of slipform casting beds 2, a plurality of transfer beds 3 for moving cut hollow-core concrete products to a storage area, a storage area 4, bridge cranes 5, 6, 7 for lifting and transferring cast concrete products and casting equipment, and water jet cutting station 8.

In the embodiment of FIG. 1, the slipform cast hollow-core concrete products are first cast as continuous slipform casting on the casting bed 2. After the casting, or during the casting process, depressions and/or grooves are formed on the top surface of the hollow-core concrete product at the predefined locations where lead-throughs or parts need to be cut away, or where other cuttings needs to be made.

The depressions and/or grooves are formed on the top surface of the fresh cast concrete product preferably with a separate slab processing machine moving on the same rails as the slipform casting machine. The slab processing machine preferably comprises a movable rotary elongate milling tool for forming the depressions and/or grooves to the fresh concrete product.

After the casting process and the formation of the depressions and/or grooves is done, the cast continuous hollow-core concrete product is left to cure on the casting bed 2. After curing, the continuous hollow-core concrete product is cut to predefined lengths with suitable machinery, such as a diamond bladed saw, on the casting bed 2, and the cut concrete products are transferred to the water jet cutting station 8 with bridge cranes 5 and 6.

In the water jet cutting station 8, the required lead-throughs and other cuttings are carried out with a water jet cutting device, in the areas of the formed depressions and grooves. The water jet cutting can be carried out to the hollow-core concrete product from the same side as the formation of the grooves and depressions, or the hollow-core concrete product can be turned around so that the water jet cutting is carried out from opposite side of the concrete product.

Once the required water jet cuttings are done, the ready hollow-core product is lifted on to transfer beds 3 and moved to a storage area 4.

Figure 2A:
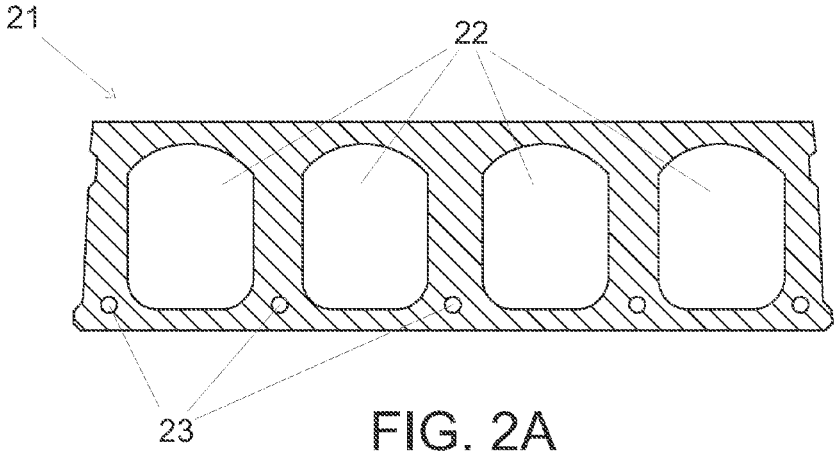
FIGS. 2A, 2B, and 2C show schematically an embodiment of the phases of the invention for creating a lead-through in a hollow-core concrete product as cross-sectional views.
Figure 2B:
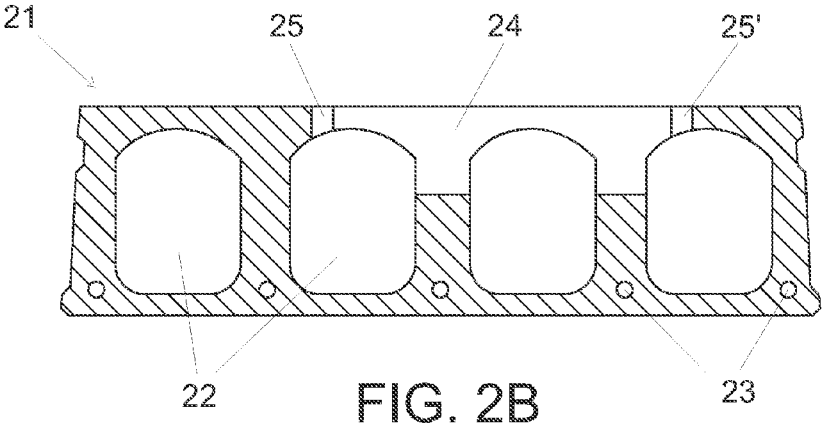

FIGS. 2A-2B show schematically an embodiment of the phases of the invention for creating a lead-through in a hollow-core concrete product 21 as cross-sectional views.

FIG. 2A shows a cross-section of the fresh slipform cast hollow-core concrete product 21 comprising cavities 22 and reinforcing wires 23.

After the slipform cast hollow-core concrete product 21 is cast, at the upper surface of the concrete product is formed transverse grooves 24 and longitudinal grooves 25, 25', which grooves restrict a rectangular area within the concrete product, as shown in FIG. 2B. The grooves 24, 25, 25' extend at least in the area where the cavities 22 are located, and preferable even deeper, but still above the reinforcing wires 23.

The width of the grooves 24, 25, 25' is such, that a nozzle of a water jet cutting device can be placed within the grooves.

Figure 2C:
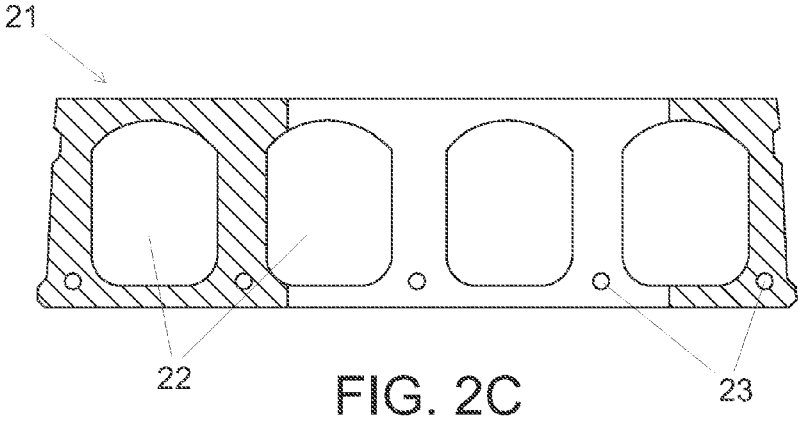

Once the hollow-core concrete product 21 is cured, the area of the concrete product defined by the grooves 24, 25, 25' is cut from the concrete product with water jet cutting. The final hollow-core concrete product after water jet cutting is shown in FIG. 2C.

The water jet is strong enough to cut through the concrete as well as the reinforcing wires 23, but the cutting speed needs generally be slowed down for cutting of the reinforcing wires.

Figure 3A:
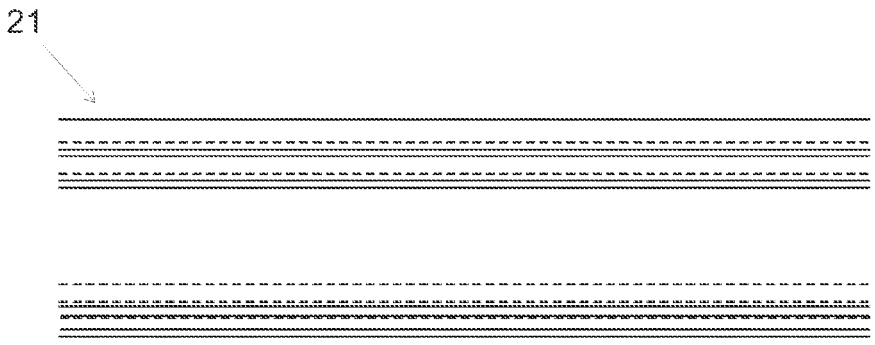
FIGS. 3A, 3B, and 3C show schematically an embodiment of the phases of the invention for cutting a hollow-core concrete product as side views.
Figure 3B:
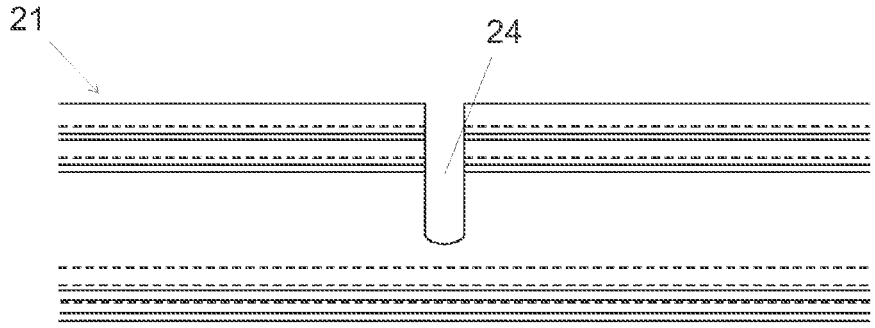
Figure 3C:
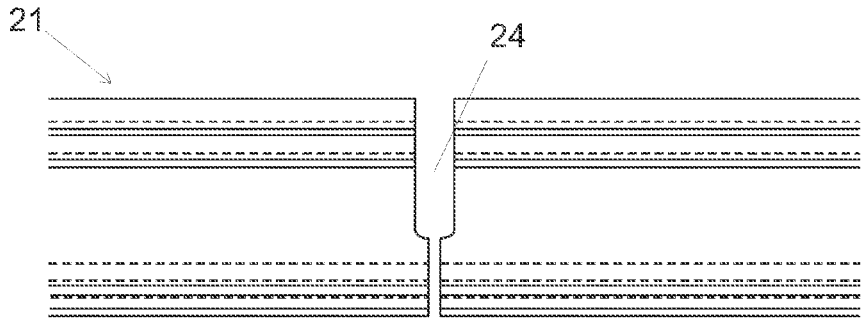

FIGS. 3A-3C show schematically an embodiment of the phases of the present invention for cutting a hollow-core concrete product 21 as side views.

In the fresh cast hollow-core concrete product 21 (FIG. 3A) is first milled a transverse groove 24 from the top surface of the product (FIG. 3B), and once the concrete product has cured, the rest of the concrete product is cut with a water jet cutting (FIG. 3C).

Since the groove 24 is wide enough for inserting the nozzle of the water jet cutting device in the groove, the water jet cutting may be carried out either through the groove 24 or from opposite side of the concrete product at the location of the groove.

The specific exemplifying embodiments of the invention shown in figures and discussed above should not be construed as limiting. A person skilled in the art can amend and modify the embodiments in many evident ways within the scope of the attached claims. Thus the invention is not limited merely to the embodiments described above.

The invention claimed is:

1. A method for cutting a slipform cast hollow-core concrete product with water jet cutting, wherein the hollow-core concrete product comprises an upper surface, a lower surface, two side surfaces and multiple hollow-cores and wherein the side surfaces and the hollow-cores are laterally arranged in between the upper surface and the lower surface, the method comprises the steps:

forming depressions, or grooves, or both, in the upper surface of the fresh cast hollow-core concrete product before curing of the hollow-core concrete product in one or more areas to be cut with water jet cutting, which depressions or grooves extend to at least some of the hollow-cores of the concrete product, wherein the forming of depressions, or grooves, or both is implemented at a casting place, curing the hollow-core concrete product, and transferring the cured hollow-core concrete product from the casting place to a separate workstation for the water jet cutting.

2. The method according to claim 1, wherein the formed depressions, or grooves, or both, in the concrete hollow-core product are large enough to contain the nozzle of a water jet cutting device.

3. The method according to claim 1, wherein the water jet cutting is implemented from the opposite side of the hollow-core concrete product from the side where the forming of the depressions, or grooves, or both has occurred.

4. An apparatus for cutting a slipform cast hollow-core concrete product with water jet cutting, which facility comprises:

one or more devices for slipform casting a hollow-core concrete product, wherein the hollow-core concrete product comprises an upper surface, a lower surface, two side surfaces and multiple hollow-cores and wherein the sides surfaces and the hollow-cores are laterally arranged in between the upper surface and the lower surface, a water jet cutting device, a device for forming depressions and grooves in the upper surface of a fresh cast hollow-core concrete product before curing of the hollow-core concrete product in one or more areas to be cut with water jet cutting, wherein said depressions and grooves extend to at least some of the hollow-cores of the concrete product; and further comprising a separate workstation for water jet cutting of a cured hollow-core concrete product.

5. The apparatus according to claim 4, wherein the device for forming depressions and grooves comprises a movable rotary elongate milling tool for milling the surface of the fresh cast hollow-core concrete product.

6. The apparatus according to claim 4, further comprising devices for transferring the cured hollow-core concrete product to the separate workstation for water jet cutting.

* * * * *